US008661693B2

(12) United States Patent
Bagley

(10) Patent No.: US 8,661,693 B2
(45) Date of Patent: Mar. 4, 2014

(54) FOLDING PIZZA WHEEL

(75) Inventor: Justin Bagley, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 77 days.

(21) Appl. No.: 13/232,916

(22) Filed: Sep. 14, 2011

(65) Prior Publication Data

US 2012/0060378 A1 Mar. 15, 2012

Related U.S. Application Data

(60) Provisional application No. 61/382,613, filed on Sep. 14, 2010.

(51) Int. Cl.
*B26B 3/00* (2006.01)

(52) U.S. Cl.
USPC ..... 30/312; 30/292; 30/319; 30/340

(58) Field of Classification Search
USPC ..... 30/292, 306, 307, 312, 313, 319, 340, 30/365; D7/694; D8/98, 99
See application file for complete search history.

(56) References Cited

U.S. PATENT DOCUMENTS

| | | | | | |
|---|---|---|---|---|---|
| 900,300 | A * | 10/1908 | Nicolas | 30/319 |
| 1,181,281 | A * | 5/1916 | Albert | 30/292 |
| 1,266,617 | A * | 5/1918 | Parsons | 30/292 |
| 2,600,646 | A * | 6/1952 | Haugland | 30/312 |
| D222,380 | S * | 10/1971 | Fraioli | D7/694 |
| 4,738,028 | A * | 4/1988 | Belokin et al. | 30/319 |
| 4,809,437 | A * | 3/1989 | Saliaris | 30/319 |
| D307,094 | S * | 4/1990 | Belokin et al. | D7/694 |
| D350,462 | S * | 9/1994 | La Gro | D7/694 |
| 6,154,967 | A * | 12/2000 | Rogala | 30/292 |
| 6,381,851 | B1 * | 5/2002 | Meyer | 30/312 |
| D461,380 | S * | 8/2002 | Law | D7/694 |
| 6,516,519 | B2 * | 2/2003 | Meyer | 30/312 |
| 6,643,936 | B2 * | 11/2003 | Carlson et al. | 30/292 |
| D501,122 | S * | 1/2005 | Lee | D7/694 |
| D509,710 | S * | 9/2005 | Lee | D7/694 |
| 7,188,424 | B2 * | 3/2007 | Webster et al. | 30/307 |
| D542,609 | S * | 5/2007 | Peterson | D7/694 |
| D589,307 | S * | 3/2009 | Mercado | D7/649 |
| D678,009 | S * | 3/2013 | Krohmer et al. | D7/694 |
| 8,555,513 | B2 * | 10/2013 | Moreland et al. | 30/319 |
| 2004/0231475 | A1 * | 11/2004 | Cornfield et al. | 30/319 |
| 2009/0223068 | A1 * | 9/2009 | Sawhney et al. | 30/319 |
| 2011/0099818 | A1 * | 5/2011 | Moreland et al. | 30/319 |

FOREIGN PATENT DOCUMENTS

BE 1013992 A6 * 1/2003

* cited by examiner

*Primary Examiner* — Jason Daniel Prone
(74) *Attorney, Agent, or Firm* — Lowe Graham Jones PLLC

(57) ABSTRACT

A pizza wheel includes a handle that is configured to fold or unfold into a variety of configurations. In a stowed, two handle halves are positioned upright, parallel to a plane defined by a cutting wheel. In a deployed position, the handle halves are rotated apart from one another to positions about 90 degrees from the original stowed position.

5 Claims, 4 Drawing Sheets

FOLDING PIZZA WHEEL

PRIORITY CLAIM

This application claims the benefit of provisional application No. 61/382,613 filed on Sep. 14, 2010 the contents of which are incorporated by reference.

FIELD OF THE INVENTION

This application generally relates to devices for cutting pizza and the like.

BACKGROUND OF THE INVENTION

Pizza is traditionally cut using any of several different cutting tools, each of which has its own shortcomings. In restaurants, some kitchens use large knives with handles on each end to cut the entire diameter of the pizza at once. This is a very specialized tool that is too large and bulky for most kitchens. Many people use a pizza wheel that includes a circular blade carried on an axle, with a handle that allows the user to wheel the cutting blade across the diameter of the pizza. The handle typically extends in a direction along a diameter from the center of the cutting wheel. Though it can be effective, it is often difficult to hold the handle in a way that allows sufficient force to cut fully through the pizza in a first pass. Accordingly, the pizza wheel can be difficult to use with pizzas having thick crusts or that otherwise require substantial force to cut through.

SUMMARY OF THE INVENTION

The present invention comprises a pizza wheel having a handle that is configured to fold or unfold into a variety of configurations. In a standard configuration, the handle is shaped in a conventional way, allowing for operation of the pizza wheel in a manner essentially the same as with conventional pizza cutting wheels.

The handle is preferably split along a central plane or otherwise formed in two handle portions, thereby allowing the handle to separate and unfold. In one configuration, the two handle halves can be pivoted or rotated approximately 90 degrees to a position in which each handle half is substantially parallel with the other and also parallel with the cutting wheel axle. In this configuration, a user can grasp each handle half while urging the wheel back and forth across the pizza. The two-handed operation is more stable and allows for greater force than would be possible with a single-handed operation.

In other versions of the invention the handle is moveable in different configurations to allow the handle halves to be positioned in a desired orientation.

In yet other versions of the invention, a pair of handle portions are movable from a first stowed position adjacent one another and a second deployed position apart from one another, with the handle portions pivoting along a central axis that is parallel with a diameter of the cutting wheel.

These and other examples of the invention will be described in further detail below.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
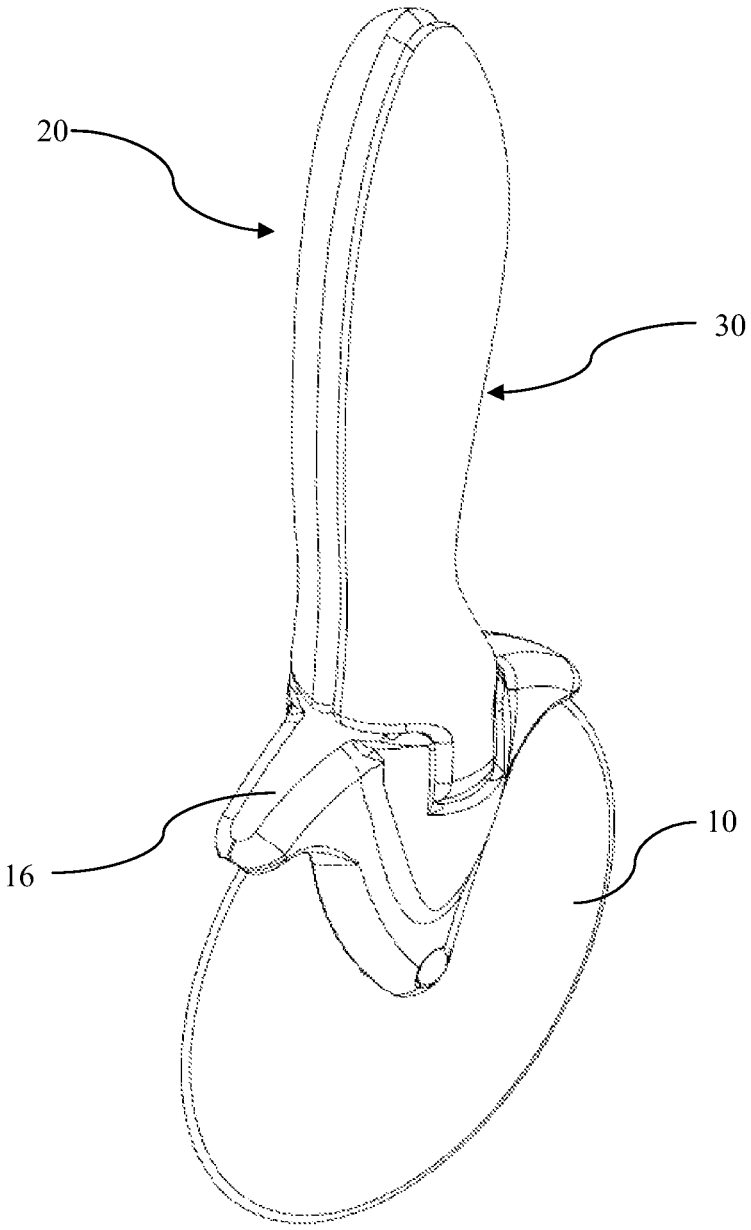
FIG. 1 is a perspective view of a folding pizza wheel, shown with the handles in a stowed configuration.

A preferred folding pizza wheel as illustrated in FIGS. 1-4 includes a wheel 10 formed from steel or other suitable materials. The wheel 10 includes a sharpened peripheral edge and a central pivot point 12 so that the wheel may be supported by an axle.

The wheel is carried by a chassis 14 that forms a frame for holding both the wheel and the handle halves, as described below. The chassis includes a lower portion extending downward to the center of the wheel to carry the axle 12. Thus, the axle extends through the wheel and is supported by the chassis. The wheel is therefore able to rotate within the chassis such that when the chassis is moved along a line above the top of a pizza or other item to be cut, the wheel rotates as it moves across the pizza, thereby cutting the pizza.

The chassis further includes a hood 16 at both a forward end and a rearward end. The hood preferably follows a curved path along a portion of the perimeter of the cutting wheel in order to protect the hand of the user from getting cut in the event the hand slips from the handle toward the wheel. As best seen in the side view, the chassis includes a first side and a second side that combine to define a central slot for receiving the cutting wheel. Adjacent the hood, the slot is preferably flared outwardly somewhat in order to facilitate ease of cleaning food particles that may become trapped within the slot. Toward the axle, the slot is preferably narrowed for a relatively snug fit round the cutting wheel. The axle may optionally be carried by a spacer or other support structure that separates the lower portion of the chassis slot if desired.

An upper portion of the chassis supports a first handle portion 20 and a second handle portion 30. In a preferred version, each of the first and second handle portions includes an outer portion 31 that is rounded for a good grip in the palm of the hand, and an inner portion 33 that is generally planar. In other versions, however, the two handle portions may take any shape, such as round, square, or other shapes in cross section. In a stowed configuration, the two inner planar handle portions abut one another with the planar faces being positioned closely adjacent one another.

In one version of the invention, the handle portions are pivotally secured to the chassis in a fashion that allows them to pivot along a common plane and through an arc of about 90 degrees. In this preferred version, the cutting wheel defines a cutting wheel plane and the handle portions pivot such that they move along a pivot plane that is orthogonal to the cutting wheel plane. Other than this path of motion within the pivot plane, the handle portions are otherwise restricted against additional movement. One preferred manner for securing the handles to the chassis for such a configuration is illustrated in the exploded view below.

Figure 2:
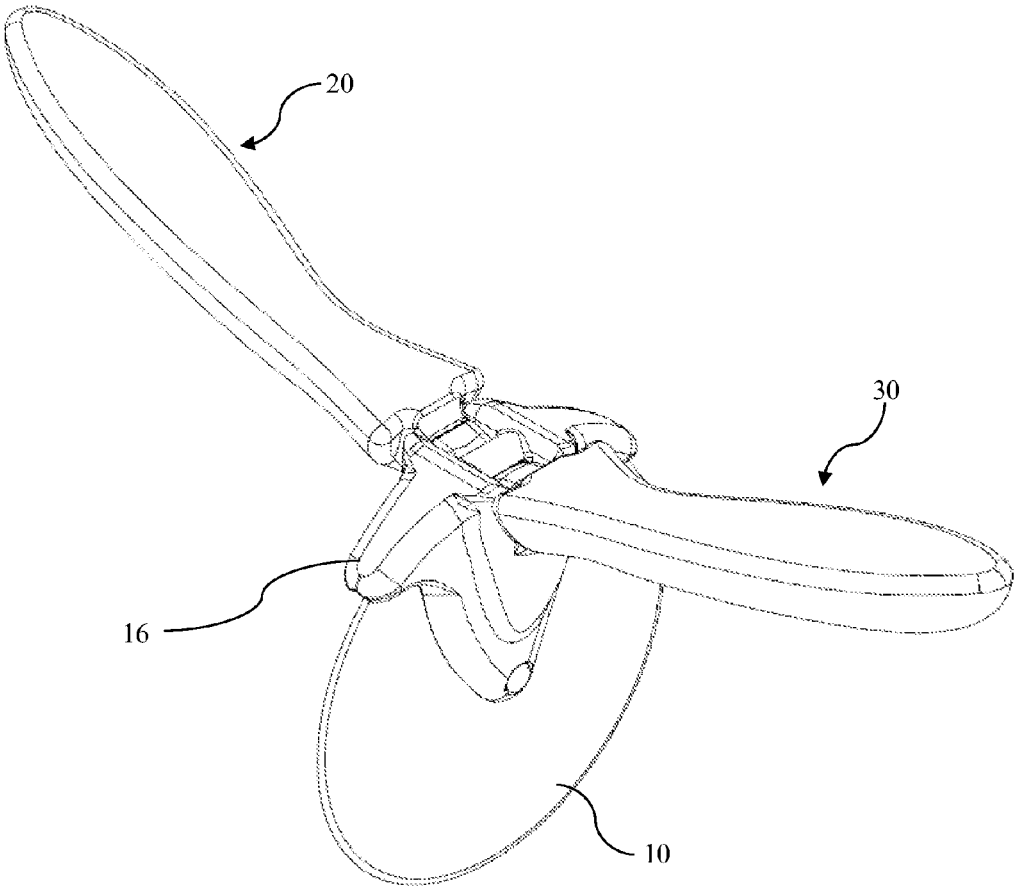
FIG. 2 is a perspective view of a folding pizza wheel, shown with the handles in a deployed configuration.
Figure 3:
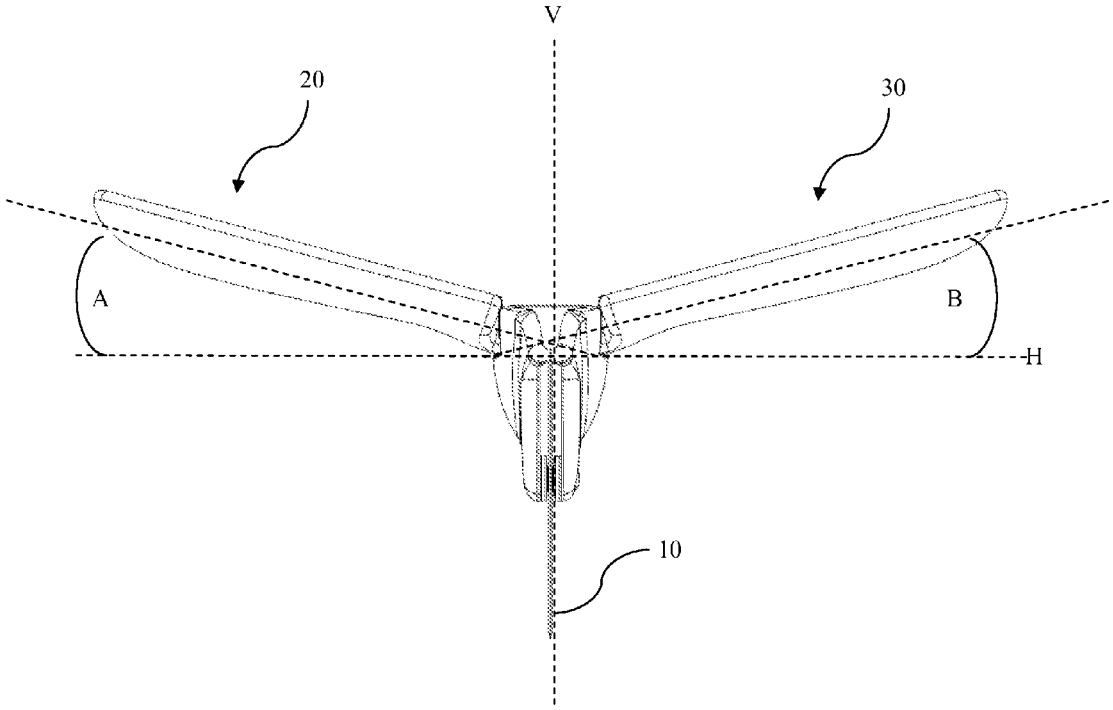
FIG. 3 is a front view of a folding pizza wheel, shown with the handles in a deployed configuration.
Figure 4:
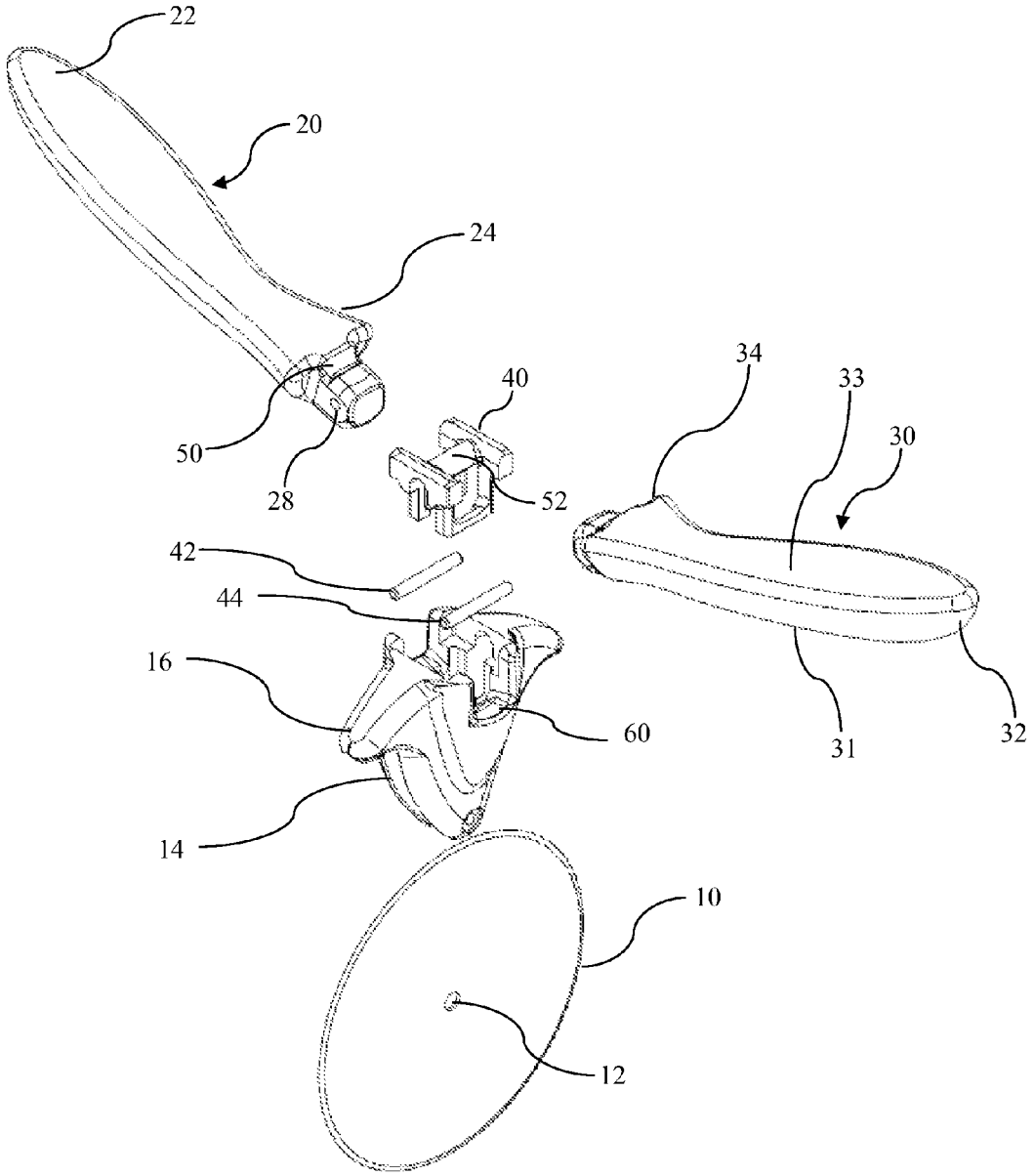
FIG. 4 is an exploded view of a folding pizza wheel.

FIG. 1 illustrates the preferred version of the cutting wheel with the handles in a stowed configuration such that they are substantially parallel to a plane defined by the wheel and closely adjacent one another. FIGS. 2 and 3 illustrate the same version with the handles in a deployed version such that the handles are approximately orthogonal to the wheel, apart from one another. In accordance with one preferred example of the invention the handle stowed position is preferably rotated about 90 degrees with respect to the deployed position. In other versions the deployed position is somewhat less inclined, and is rotated about 70 degrees or about 80 degrees or more with respect to the plane defined by the wheel.

In general, there are two main positions for the handle portions, including the stowed position and the deployed position. Most preferably, in the stowed potions the handles are parallel to the plane defined by the cutting wheel while in the deployed position they are at an angle of greater than 45 degrees with respect to the plane defined by the cutting wheel. The preferred handle orientation in the deployed position is best seen in FIG. 3. The cutting wheel lies in a plane parallel to the central axis V (for vertical). An axis perpendicular to the central axis is indicated by the line H (for horizontal). In some versions the handle portions in the deployed position may be substantially parallel to the horizontal axis H, meaning they would also be perpendicular to the vertical axis V. With respect to this invention, a handle portion is "substantially" perpendicular to the plane defined by the cutting wheel when it extends along a line at an angle 20 degrees or less with respect to the plane of the cutting wheel (as indicated by angles A and B in FIG. 3). Alternately stated, a handle portion is substantially perpendicular to the cutting wheel when it extends along a line at 70 degrees or more with respect to the plane defined by the cutting wheel. In the preferred example of the invention, the handle portions are at an angle greater than 60 degrees with respect to the vertical axis V in the deployed position.

In this preferred version, each handle portion includes a distal end 22, 32 and a proximal end 24, 34. The proximal ends are formed with substantially flat vertical side faces that are received within a channel 60 formed in the upper end of the chassis. The channel includes complementary vertical faces (substantially perpendicular to the cutting wheel plane) that allow for sliding movement of the handle portions within the channel in a vertical direction. Each handle portion further includes a bore 28 for receiving a pin 42, 44. The bores are oriented substantially horizontally, such that when the handle is mounted the bores are perpendicular to the vertical faces formed on the proximal ends of the handles. Each pin extends through a bore in one of the two handle portions, with a portion at each end of the pin extending beyond the width of the proximal end of the handle and therefore outside the bore. The proximal portion of the handle, together with the extended pin, fits within the channel and is trapped within the channel by a handle mount 40. The handle mount forms an internal shoulder that engages the extended ends of the pins in order to retain them between the handle mount and the chassis. The handle mount is secured to the chassis in this fashion, using an adhesive, press-fit, or other suitable means. By trapping the extended pivot pins between the chassis and the handle mount, the handle portions are secured to the chassis. Accordingly, the handle portions are allowed to pivot along an axis defined by each of the pins, constrained within a single plane of movement by the abutting vertical faces.

The proximal ends of the handle portions may each include a curved shelf 50 or other similar shape that is configured to allow the handle portions to rotate fully in an upward position without being obstructed by a center beam 52 formed on the handle mount.

The center beam 52 and/or a lower edge of the channel 60 serve to limit the rotational travel of the handles in the downward position, thereby supporting the handles in a position that is preferably no more than 90 degrees from the original vertical stowed position.

The particular configuration for pivotal movement of the handle portions as described above is one preferred embodiment. In other examples, the pivotal movement may be obtained using different connections between the handle portions and the chassis. For example, the pins may be formed in a portion of the chassis or a handle mount and extend into either a bore or a depression formed in the handle portion. As another alternative, the handle portions may include an integrally formed pin extending outward and received by the chassis or handle mount. In yet another alternative, the handle portion may include a centrally formed slot that receives an axle for pivotal movement. These or other configurations are suitable for allowing pivotal movement of the handle portions.

Each of the handle portions may optionally include a mechanism for retaining the handle portions in a stowed position, adjacent one another. Preferably, the mechanism for retaining the handles comprises magnets secured to the distal ends of each of the handle portions. A first magnet is secured to the first handle portion and a second magnet is secured to the second handle portion, with the first magnet and the second magnet being oriented such that opposing poles face one another when the handle portions are stowed and adjacent one another. In a preferred version, the magnets are molded within the handles. The handle portions may also be formed using separate handle portion components that define an internal space that is at least partially hollow, thereby allowing the magnets to be placed within the internal space before joining the separate handle portion components together.

In other versions of the invention, different mechanisms may be used for retaining the handles in a stowed position. For example, in one version the first handle portion includes a projection while the second handle portion includes a complementary well. The projection and well are formed and positioned such that the projection is received within the well when the handle portions are in a stowed position, adjacent one another. By forming the size of the projection larger than that of the well, the two portions are snap-fit together in the stowed position. As yet another example, a ring-shaped collar may be positioned to slide over the distal ends of the handle portions to hold them together in the stowed position.

In some versions of the invention, the handle portions are not restricted to pivotal movement along a single plane, but rather can rotate along a curved path of motion. In such a version, the proximal ends of the handle portions may be secured to the chassis using a ball and socket or other such arrangement that allows for both pivotal and rotational movement. Alternatively, the handle portions may be secured in a fashion that allows for only pivotal movement, but in which the pivot axis for each handle portion is non-orthogonal with respect to the cutting wheel plane. The handle portions or chassis may include stops formed in order to limit pivotal or rotational travel, for example to restrict the handle portions from movement below a position generally perpendicular to the cutting wheel.

In yet another version, each of the handle portions may be formed in an "L" shape. In such a version the handle portions include a stem extending vertically from the chassis that forms the base of the L shape. The handle portions further include an integrally formed horizontal portion extending from the vertical stem forming the upright of the L shape. Each of two handle portions is pivotally secured to the chassis at the stem, allowing for pivotal movement about a pivot axis that is substantially parallel with a diameter of the cutting wheel. Accordingly, in a first stowed position the two handle portions are adjacent one another to form a single handle in which a short vertical stems are generally positioned along a diameter of the wheel cutter and the horizontal handle portions are perpendicular to the stem. In the deployed position the horizontal handle portions swing outward from each other along a horizontal plane that is orthogonal to the cutting wheel plane and also orthogonal to the stems. When fully deployed, the distal ends of the handle portions preferably lie on opposite ends of a straight line that is substantially parallel with the axle of the cutting wheel.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A folding pizza wheel, comprising:

a cutting wheel having a peripheral sharpened edge and being configured to rotate about a pivot axis, the cutting wheel defining a plane of rotation perpendicular to the pivot axis;

a chassis configured to support the cutting wheel for rotation, the chassis having a first side and a second side forming a central slot for receiving the cutting wheel for rotation within the central slot, the chassis further having a forward hood and a rearward hood, the forward hood and rearward hood being positioned adjacent an edge of the cutting wheel;

a first handle portion pivotally attached to the chassis; and a second handle portion pivotally attached to the chassis, wherein the first handle portion and the second handle portion are each rotatable between a stowed position in which the first handle portion and the second handle portion are adjacent one another and extend radially away from the cutting wheel, and a deployed position in which the first handle portion and the second handle portion are apart from one another, each of the first handle portion and second handle portion being nonparallel to the cutting wheel plane in the deployed position;

the chassis further having a channel formed between the forward hood and the rearward hood, each of the first handle portion and the second handle portion being mounted in the channel;

the channel further having a center beam, the center beam forming a surface to limit rotational movement of the first handle portion and the second handle portion;

the first handle portion and the second handle portion each being positioned at an angle of greater than 80 degrees with respect to the plane of rotation in the deployed position.

2. The folding pizza wheel of claim 1, wherein the first handle portion and the second handle portion are each parallel to the plane of rotation in the stowed position.

3. The folding pizza wheel of claim 1, wherein the first handle portion is pivotally attached to the chassis by a first pin carried on a first side of the center beam, and the second handle portion is attached to the chassis by a second pin carried on a second side of the center beam.

4. A folding pizza wheel, comprising:

a cutting wheel having a peripheral sharpened edge and being configured to rotate about a pivot axis, the cutting wheel defining a plane of rotation perpendicular to the pivot axis;

a chassis configured to support the cutting wheel for rotation about the pivot axis, the chassis having a first side and a second side forming a central slot for receiving the cutting wheel for rotation within the central slot, the chassis further having a forward hood and a rearward hood, the forward hood and rearward hood being positioned adjacent an edge of the cutting wheel;

a first handle portion pivotally attached to the chassis; and a second handle portion pivotally attached to the chassis;

the chassis further having a channel formed between the forward hood and the rearward hood, each of the first handle portion and the second handle portion being mounted in the channel;

the channel further having a surface for abutting the first handle portion and the second handle portion to limit rotational movement of the first handle portion and the second handle portion;

wherein the first handle portion and the second handle portion are each selectively positionable at a stowed position in which the first handle portion and the second handle portion are adjacent one another, and a deployed position in which the first handle portion and the second handle portion are apart from one another and at an angle of greater than 60 degrees with respect to the plane of rotation.

5. The folding pizza wheel of claim 4, wherein in the stowed position the first handle portion and the second handle portion are substantially parallel to the plane of rotation.

* * * * *